US008152442B2

(12) United States Patent
Helmer et al.

(10) Patent No.: US 8,152,442 B2
(45) Date of Patent: Apr. 10, 2012

(54) CENTRIPETAL PUMPING STAGE AND VACUUM PUMP INCORPORATING SUCH PUMPING STAGE

(75) Inventors: John C. Helmer, Eugene, OR (US); Silvio Giors, Turin (IT)

(73) Assignee: Agilent Technologies, Inc., Santa Clara, CA (US)

( * ) Notice: Subject to any disclaimer, the term of this patent is extended or adjusted under 35 U.S.C. 154(b) by 613 days.

(21) Appl. No.: 12/343,961

(22) Filed: Dec. 24, 2008

(65) Prior Publication Data

US 2010/0158667 A1 Jun. 24, 2010

(51) Int. Cl.
*F04D 1/04* (2006.01)

(52) U.S. Cl. ..... 415/55.1; 415/90

(58) Field of Classification Search ..... 415/55.1–55.7, 415/90, 143

See application file for complete search history.

(56) References Cited

U.S. PATENT DOCUMENTS 5,374,160 A * 12/1994 Hablanian ..... 415/90
5,553,998 A * 9/1996 Muhlhoff et al. ..... 415/90
5,688,106 A 11/1997 Cerruti et al.
5,695,316 A * 12/1997 Schutz et al. ..... 415/90
6,394,747 B1 5/2002 Hablanian
6,877,949 B2 * 4/2005 Cerruti et al. ..... 415/90
7,223,064 B2 * 5/2007 Hablanian ..... 415/90
2001/0055526 A1 12/2001 Kawasaki
2005/0047904 A1 * 3/2005 Rival ..... 415/90
2008/0056886 A1 * 3/2008 Hablanian ..... 415/90
2008/0112790 A1 * 5/2008 Beyer et al. ..... 415/55.1

FOREIGN PATENT DOCUMENTS

GB 332879 7/1930

OTHER PUBLICATIONS

International Search Report and Written Opinion From Corresponding PCT Application No. PCT/US2009/067196, Jun. 30, 2010 (12 pgs).

* cited by examiner

*Primary Examiner* — Gary F. Paumen

(57) ABSTRACT

A molecular spiral-type vacuum pumping stage comprises a rotor disk having smooth surfaces cooperating with a stator. The stator is provided with a plurality of spiral channels at least on the surface facing the rotor disk, wherein the gas to be pumped flows in centripetal direction. The cross-section area (σ) of the channels is reduced from the center towards the outer periphery of the stator. Due to this arrangement, it is possible to avoid the reduction of the internal gas flow velocity along the pumping stage and the related risk of internal compression or re-expansions, this limiting the power losses. The present invention also refers to a vacuum pump comprising at least one pumping stage as described above.

18 Claims, 8 Drawing Sheets

CENTRIPETAL PUMPING STAGE AND VACUUM PUMP INCORPORATING SUCH PUMPING STAGE

CROSS-REFERENCE TO RELATED APPLICATION

This application is related to the application of Varian S.p.A. application Ser. No. 12/343,980 entitled "SPIRAL PUMPING STAGE AND VACUUM PUMP INCORPORATING SUCH PUMPING STAGE"

FIELD OF THE INVENTION

The present invention relates to a spiral pumping stage for vacuum pump. More particularly, the present invention relates to an improved spiral molecular pumping stage and to a vacuum pump comprising said pumping stage.

BACKGROUND OF THE INVENTION

Molecular drag pumping stages produce pumping action by momentum transfer from a fast-moving surface (moving at speed comparable to thermal speed of the molecules) directly to gas molecules. Generally, said pumping stages comprise a rotor and a stator cooperating with each other and defining a pumping channel therebetween: collisions of gas molecules in the pumping channel with the rotor rotating at a very high speed cause gas in the channel to be pumped from the inlet to the outlet of the channel itself.

With reference to FIG. 1, between 1920-1930 Karl Manne Georg Siegbahn developed a molecular pumping device 10, wherein the pumping action is obtained through the cooperation of a rotor disk 20 having smooth surfaces integral with a rotating shaft 30 with a pair of stator bodies 40, 50, each facing a rotor disk surface and provided with a corresponding spiral-shaped groove 60 open towards the respective surface of the rotor disk and defining therewith a corresponding pumping channel.

The Siegbahn patent GB 332,879 discloses an arrangement of the above-mentioned kind. The gas to be pumped, entering through an inlet 70 at the outer periphery of each pumping groove flows in both spiral channels in centripetal direction, i.e. from the outer periphery towards the pumping grooves, as indicated by arrows CP. In this case, two spiral pumping channels in parallel are to be considered, the gas flows in both channels in centripetal direction.

According to Siegbahn, in order to control the resistance of the gas pumped through the spiral channels 60, the cross-section area of these channels is reduced from the outer periphery of the stator bodies towards their center, in accordance with the reduction of the tangential speed of the disk, in the direction of the gas flow.

U.S. Pat. No. 6,394,747 (M. Hablanian) discloses a vacuum pump having reduced overall size and weight utilizing for these purposes a pair of Siegbahn-type pumping stages connected in series rather than in parallel.

According to U.S. Pat. No. 6,394,747 disclosure, a rotor disk having smooth surfaces is placed between a first stator body and a second stator body, each of these stator bodies are provided with a spiral groove open towards the respective surface of the rotor disk and defining therewith a corresponding pumping channel. At the beginning, the gas to be pumped flows between the first stator body and the rotor disk in centrifugal direction, from the center to the outer periphery of the rotor disk, and then between the second stator body and the rotor disk in centripetal direction, i.e. from the outer periphery to the center of the rotor disk.

The cross-section area of the groove defining the pumping channel in the first stator disk—wherein the gas flows in centrifugal direction—is reduced from the centre to the outer periphery, while the cross-section area of the groove defining the channel in the second stator disk—wherein the gas flows in centripetal direction—is reduced from the outer periphery to the centre.

In both channels, the cross-section area of the groove defining the pumping channel is reduced concordantly with the advancing direction of the flow of the gas that is pumped through the channel itself. In this way, U.S. Pat. No. 6,394,747 aims at optimizing the pumping speed and the compression ratio.

In known Siegbahn-type pumping stage, having the above-mentioned geometric configuration, the volumetric internal channel speed (L/s), given by the product of the channel cross-section area and half the rotor velocity normal to the aforesaid area, is reduced concordantly with the gas flow direction. This may constitute a drawback in applications with high gas flow rates, since it generates the risk of internal compressions and successive re-expansions and corresponding power losses.

The main object of the present invention is to provide a centripetal pumping stage for vacuum pump, which allows to overcome the above-mentioned drawback and to reduce power losses, when several stages are connected in series. This and other objects are achieved by centripetal and centrifugal pumping stages of the present invention.

SUMMARY OF THE INVENTION

The pumping stage according to the present invention comprises a stator body having at least one spiral channel on a first surface, wherein the gas flows in centripetal direction, the cross-section area of the channel is reduced in a direction opposite to the advancing direction of the gas flow.

It is provided that the stator body may comprise on its opposite surface an additional spiral channel, wherein the gas flows in centrifugal direction. The cross-section area of the additional channel is reduced concordantly with the advancing direction of the gas flow.

Advantageously, according to the invention the reduction of the gas pumping velocity of the spiral channels, as well as the corresponding risk of internal compressions or expansions, can be avoided.

According to the present invention the variation of the cross-section area of the grooves defining the spiral channel of the pumping stage stator body is designed based on geometrical structure, independently from the advancing direction of the gas flow, and, more particularly, the area is reduced from the center towards the outer periphery of the stator body, so as to compensate for the increase of the disk tangential speed, whichever the flowing direction of the pumped gas may be. Due to this arrangement, according to a preferred embodiment of the invention the volumetric channel speed can be maintained constant over the whole pumping channel.

It is evident to the person skilled in the art that the above-mentioned structural feature, in addition to reducing power losses, also constitutes a remarkable advantage with respect to simplicity and cost reduction during the manufacturing process, since all the stator bodies can be made identical, but for the winding direction of the spiral, without regard to whether they are used in centripetal or centrifugal pumping sections.

Advantageously, the pumping stage according to the invention can be used in a vacuum pump in combination with other pumping stages, of the same kind or of a different kind. For example, the pumping stage can be provided downstream of a plurality of turbomolecular axial pumping stages. Also, the pumping stage can be provided upstream of a Gaede pumping stage and/or regenerative pumping stage.

According to first preferred application of the invention to a vacuum pump, the pumping stage is connected in series to another spiral pumping stage, wherein the gas to be pumped flows in centrifugal direction. The pumping stage also comprising a spiral channel, the cross-section area of which is reduced from the center to the outer periphery of the stator body, preferably obtained on the opposite surface of the same stator body, wherein the pumping stage is defined, and most preferably comprises a spiral channel the cross-section are of which varies according to the same geometry as the pumping stage according to the invention. According to a second preferred application of the invention to a vacuum pump, the pumping stage is connected in series to two or more spiral pumping stages connected in parallel to each other, wherein the gas to be pumped flows in centrifugal direction, also comprising a spiral channel, the cross-section area of which is reduced from the center to the outer periphery of the stator body.

According a third preferred application of the invention to a vacuum pump, the pumping stage according to the invention is connected in parallel to one or more further spiral pumping stages according to the invention, wherein the gas to be pumped flows in centripetal direction, comprising a spiral channel, the cross-section area of which is reduced from the center to the outer periphery of the stator body.

BRIEF DESCRIPTION OF THE DRAWINGS

Further advantages and features of the invention will be evident from the detailed description of some preferred embodiments of the invention, given by way of non-limiting example, with reference to the attached drawings, wherein.

DETAILED DESCRIPTION OF THE INVENTION

Figure 1:
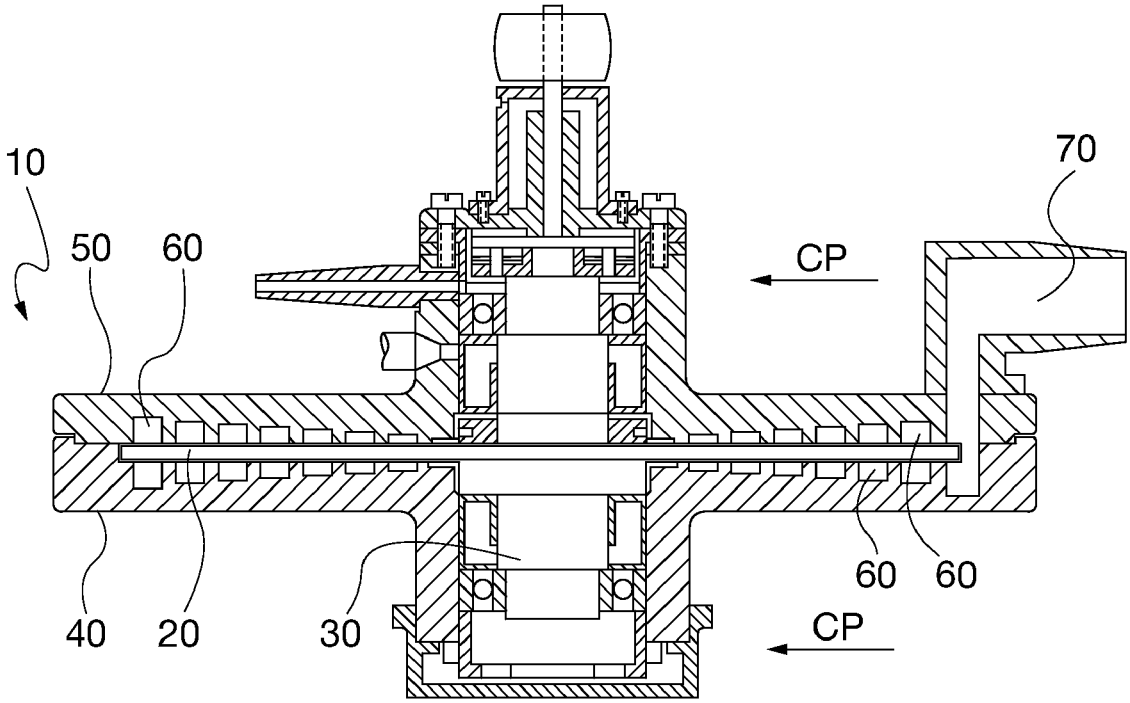
Fig. 1 (PRIOR ART)
FIG. 1 is a cross-sectional view of a known Siegbahn-type pump.
Figure 2A:
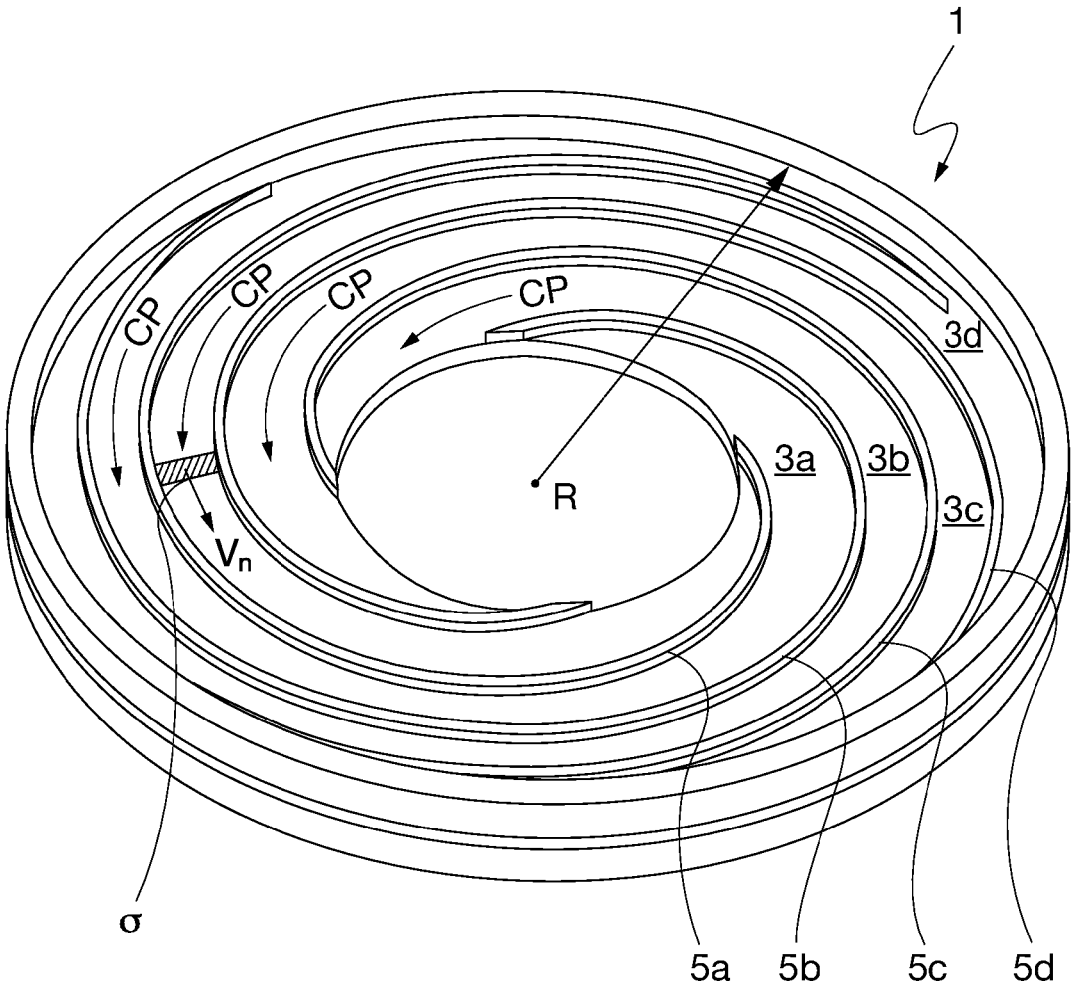
FIG. 2*a* is a perspective view of a stator body of a pumping stage according to the present invention.
Figure 2B:
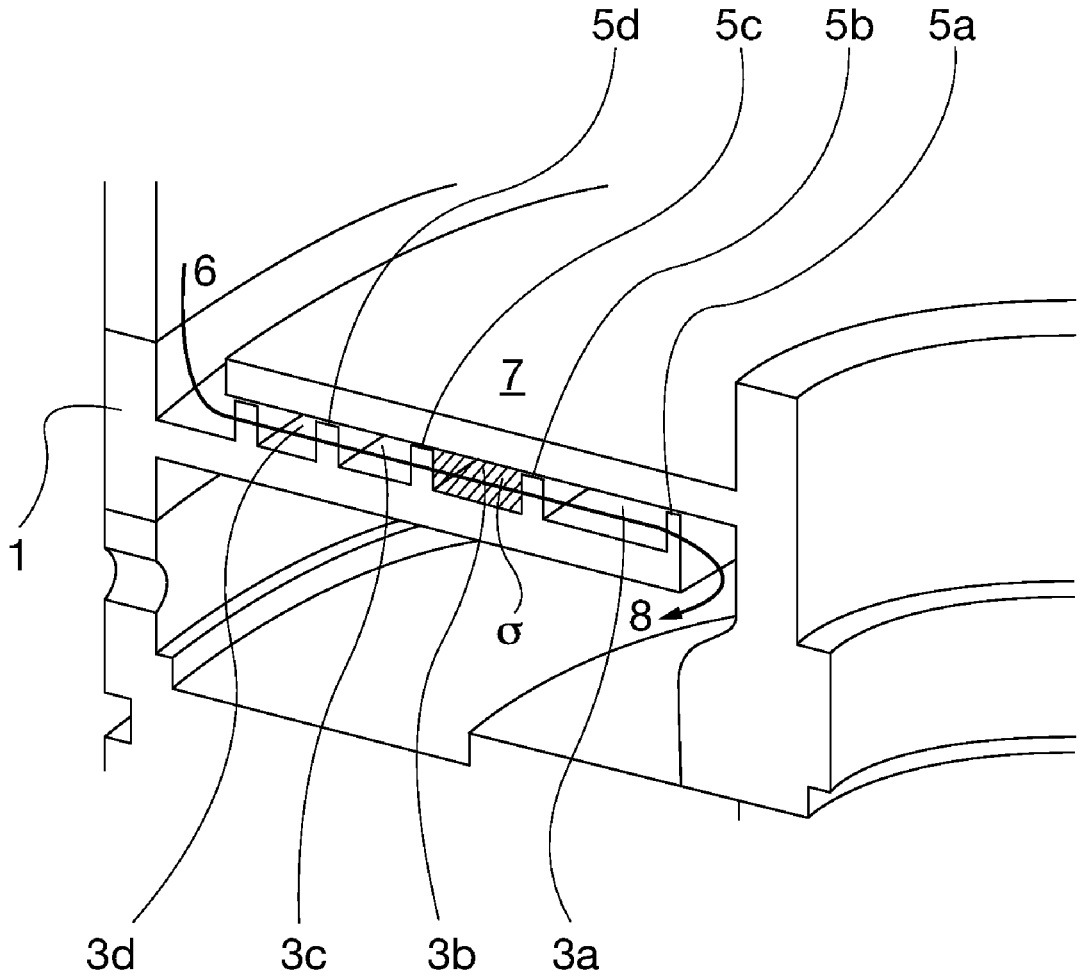
FIG. 2*b* is a cross-sectional view of a pumping stage incorporating the stator body of FIG. 2*a;*

With reference to FIGS. 2*a* and 2*b*, the pumping stage comprises a rotor disk 7 having smooth surfaces co-operating with a stator body 1, which comprises on the surface facing the rotor disk 7 a plurality of spiral channels 3*a*, 3*b*, 3*c*, 3*d*, connected in parallel and separated from each other by corresponding spiral ribs 5*a*, 5*b*, 5*c*, 5*d*. The pumping stage comprises a gas inlet 6 at or close to the outer periphery of the stator body 1 and a gas outlet 8 at or close to the center of said stator body, so that the gas to be pumped flows through channels 3*a*, 3*b*, 3*c*, 3*d* in a centripetal direction, as indicated by arrows CP in FIG. 2*a*.

According to the invention, the cross-section area a of channels 3*a*, 3*b*, 3*c*, 3*d* is reduced from the center to the outer periphery of the stator body 1, i.e. as the distance R from the center of stator body 1 increases.

As known, tangential velocity $V_T=\omega R$ of a rotor is reduced concordantly with radius R from the outer periphery towards the center of the stator body.

According to a preferred embodiment, the cross-section area σ of channels 3*a*, 3*b*, 3*c*, 3*d* varies so that, the volumetric channel speed (S), the condition is satisfied according to which $$S=V_n\times\sigma=\text{CONSTANT} \tag{1}$$

wherein $V_n$ is half the rotor velocity normal to area σ.

More particularly, according to a preferred embodiment of the invention, the shape of the spiral channels of the stator body 1 is defined so that along each spiral channel the condition is always satisfied according to which:

$$S = 2\pi\omega H(R)R^2\frac{\frac{dR}{Rd\phi}}{1+\left[\frac{dR}{Rd\phi}\right]^2} = \text{CONSTANT} \tag{2}$$

wherein $\omega=V_T/R$ is the rotor angular velocity;

H(R) is the height of the channel, possibly variable as a function of R;

ϕ is the winding angle of the channel spiral

It will be evident to an expert in the field that a spiral pumping stage whose channel has a shape determined by the values of R and ϕ, which—although they do not represent an exact solution of the equations (1) and (2)—are in any case a good approximation thereof, still falls within the scope of protection of the present invention. In particular, a spiral pumping stage wherein R and ϕ have a deviation not higher than ±10% with respect to the exact solution of the equations (1) and (2) set forth above or has a channel speed S which is CONSTANT within a deviation of ±10% along the channel itself, allows to effectively reach the objects of the present invention.

According to a first order approximation of the above equation and considering, in order to simplify the manufacturing, a channel with constant height H, the channel shape is defined by:

$$S = 2\pi\omega\frac{RdR}{d\phi} = \text{CONSTANT.} \tag{3}$$

By integration, it is obtained:

$$\frac{R^2-R_1^2}{R_2^2-R_1^2} = \frac{\phi}{\phi_o},$$

wherein $R_1$ and $R_2$ are the inner radius and the outer radius of the stator channel, respectively;

$\phi_0$ is the overall winding angle of the spiral (360° in the example of FIG. 2*a*).

As disclosed above, by maintaining the volumetric channel speed constant, the risk of internal expansions or compressions is avoided and the power losses are limited.

It will be evident to the person skilled in the art that the geometrical configuration of the pumping stage is not only different, but even opposite to the geometrical configuration used in the known art.

Furthermore, for compensation of the possible reduction of the compression ratio, it is sufficient to define an adequate number of ribs defining as many spiral channels in parallel in the stator body (four in the example of FIG. 2*a*). According to a preferred embodiment, the number of channels is chosen so that a theoretical observer placed at the center of the stator body always meets at least two ribs when moving in the radial direction from the center to the outer periphery of the stator body. In other words, any radius vector originated at the center of the stator body intercepts at least two curved vanes when moving in indicated direction.

Figure 3:
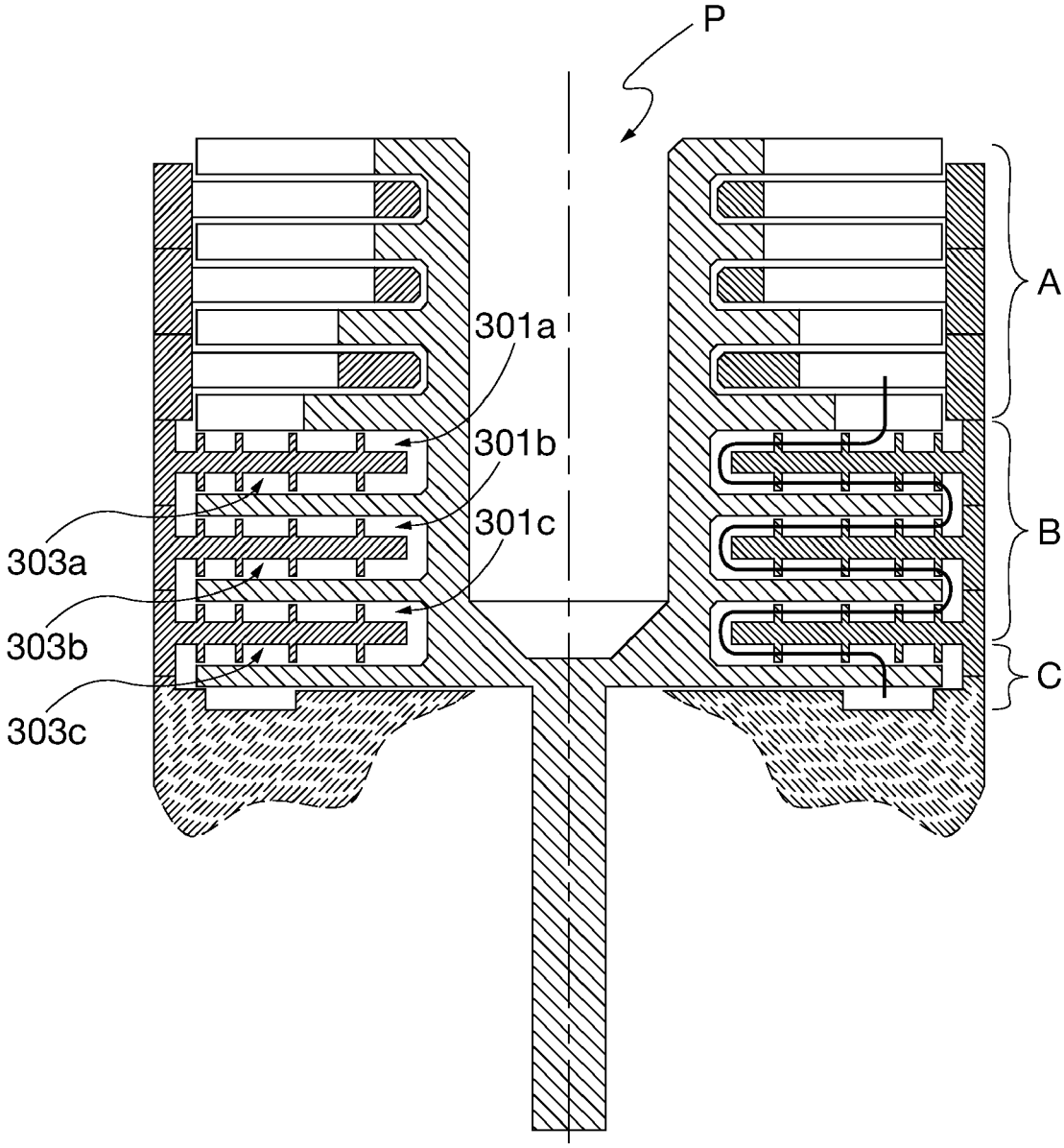
FIG. 3 is a cross-sectional view of a vacuum pump according to a first embodiment of the invention.
Figure 4:
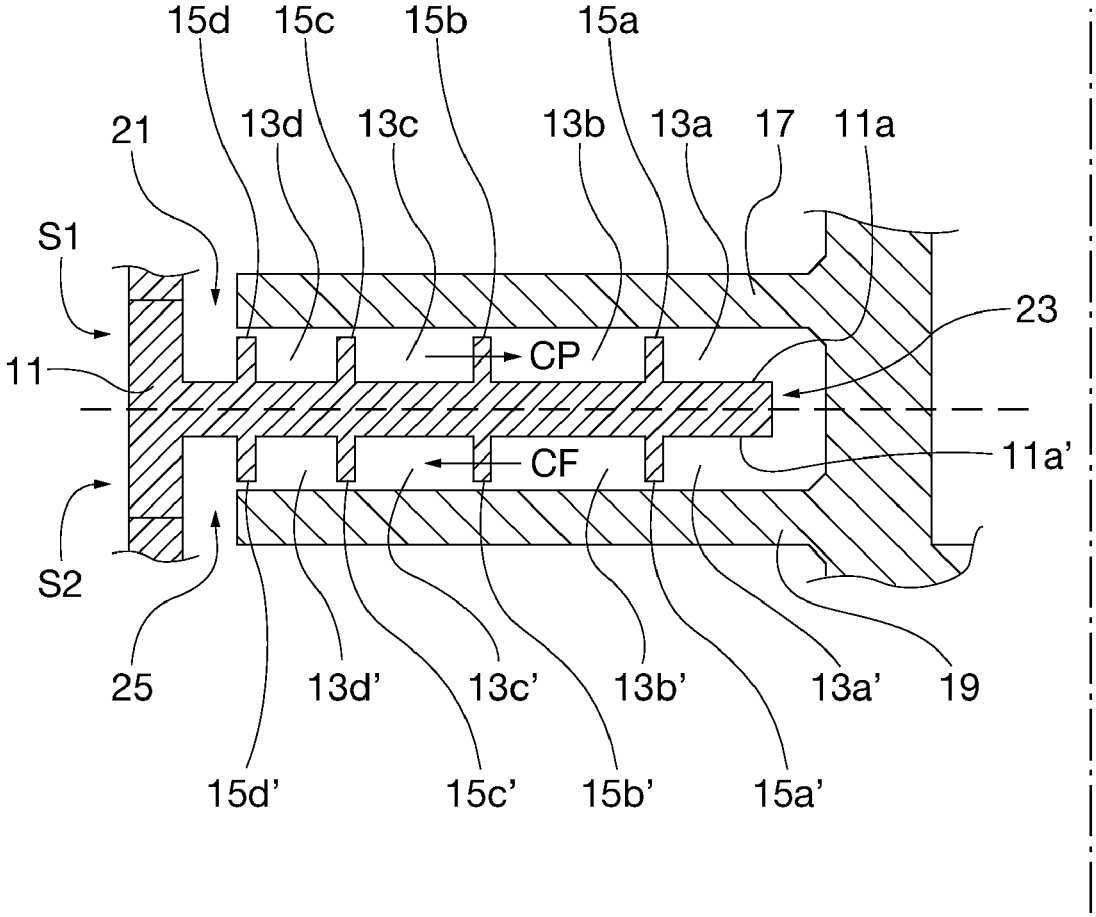
FIG. 4 is an enlarged view of a detail of the vacuum pump of FIG. 3.

Turning now to FIGS. 3 and 4, which show a first embodiment of a vacuum pump P. According to the art the vacuum pump comprises an inlet for the gas to be pumped at lower pressure, an outlet for the pumped gas at higher pressure and a plurality of pumping stages provided between said inlet and said outlet. The pump P of the present invention further comprises three regions. A first region A is at low pressure, where a plurality of turbomolecular axial pumping stages connected in series are provided; a second region B is at intermediate pressure, wherein some spiral pumping stages connected in series are provided; and a third region C at high pressure, wherein one or more Gaede pumping stages, which can possibly be followed or replaced by regenerative stages, are provided.

More particularly, the intermediate region B of the vacuum pump P comprises one or more pumping stages 301*a*, 301*b*, 301*c* according to the invention (three in the example shown in FIG. 3). Advantageously, pumping stages 301*a*, 301*b*, 301*c* are connected in series with as many centrifugal spiral pumping stages 303*a*, 303*b*, 303*c*, alternated with the centripetal stages according to the invention, so as to make the vacuum pump P more compact.

With reference to FIG. 4, a first pumping stage S1 according to the invention and a second centrifugal spiral pumping stage S2 connected in series are shown in detail. A stator body 11 is provided on both surfaces 11*a*,11*a*' with spiral channels 13*a*, 13*b*, 13*c*, 13*d* and 13*a*', 13*b*', 13*c*', 13*d*', separated by corresponding spiral ribs 15*a*, 15*b*, 15*c*, 15*d* and 15*a*, 15*b*'15*c*', 15*d*', respectively.

A first rotor disk 17 having smooth surfaces is located opposite to a first surface 11*a* of the stator 11 and co-operates therewith for forming a first pumping stage S1 according to the invention. A second rotor disk 19 having smooth surfaces is located opposite to a second surface 11*a*' of the stator 11 and co-operates therewith for forming a second pumping stage S2, also spiral-shaped.

The gas, coming from an inlet 21 placed at the outer periphery of the first pumping stage S1 flows through the first pumping stage S1 in centripetal direction (as indicated by arrow CP), passes through the passage 23 provided at or close to the center of said stator body 11 that connects the two stages S1 and S2 and then flows through the second pumping stage S2 in centrifugal direction (as indicated by arrow CF), successively exiting through an outlet 25 placed at the outer periphery of the second pumping stage S2.

With reference again to FIG. 3, it is evident that the inlet 21 can put a turbomolecular pumping stage or a previous centrifugal spiral pumping stage or a pumping stage of other kind in the region A in communication with the first pumping stage S1 of the region B; the same way the outlet 25 of the last pumping stage of the region B can put the pumping stage S2 in communication with a successive pumping stage according to the invention or with a Gaede pumping stage or even with a regenerative pumping stage or with a pumping stage of other kind in the region C.

As described above, according to the invention, the cross-section area of channels 13*a*, 13*b*, 13*c*, 13*d* of the first pumping stage S1 is reduced from the center to the outer periphery of the stator body 11. Preferably, the cross-section area of channels 13*a*', 13*b*', 13*c*', 13*d*' of the second pumping stage S2 is also reduced from the center to the outer periphery of the stator body 11. More particularly, the cross-section area of channels 13*a*', 13*b*', 13*c*', 13*d*' preferably varies in the same way as channels 13*a*, 13*b*, 13*c*, 13*d*. More preferably, the cross-section area both of channels 13*a*, 13*b*, 13*c*, 13*d* of the first pumping stage S1 and of channels 13*a*', 13*b*', 13*c*', 13*d*' of the second pumping stage S2 varies so that the internal pumping speed is constant along the pumping stages S1 and S2 and, more particularly, satisfies the condition of formula (1) or (2) or (3).

Figure 5:
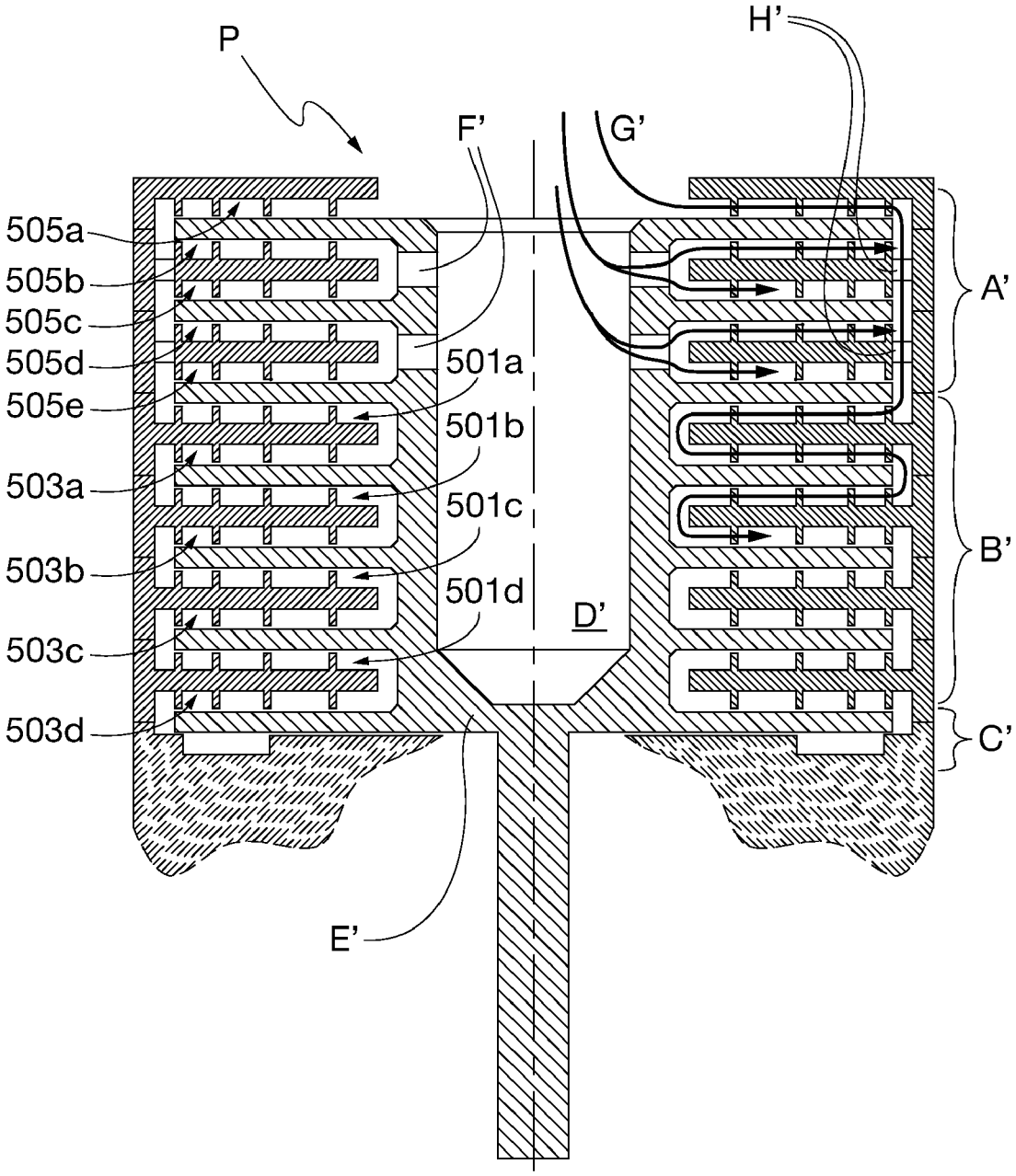
FIG. 5 is a cross-sectional view of a vacuum pump according to a second embodiment of the present invention.

Turning now to FIG. 5, a second embodiment of a vacuum pump P' is shown. The pump P' comprises a first region A' at low pressure, wherein a plurality of centrifugal spiral pumping stages connected in parallel are provided (five in the example shown in FIG. 5); a second region B' at intermediate pressure, wherein spiral pumping stages connected in series are provided; and a third region C' at high pressure, wherein one or more Gaede pumping stages (which can possibly be followed or replaced by regenerative stages) are provided.

The second region B' at intermediate pressure of vacuum pump P' comprises one or more pumping stages 501*a*, 501*b*, 501*c* (three in the embodiment shown in FIG. 5). The pumping stages 501*a*, 501*b*, 501*c* are connected in series with as many centrifugal spiral pumping stages 503*a*, 503*b*, 503*c*, alternated with the centripetal stages according to the invention.

Regarding the first region A' at low pressure, for obtaining the centrifugal spiral pumping stages 505*a*, 505*b*, 505*c*, 505*d*, 505*e* connected in parallel, the wall of the central cavity D' of the rotor E' comprise radial through-holes F', so that the gas arriving from inlet G' penetrates inside the cavity D' of the rotor E', passes through the through-holes F' and is subdivided among the several pumping stages of the first region A', being successively collected in a collector defined by holes H'.

Similar to the pumping stages according to the invention, preferably the centrifugal spiral pumping stages of region A' at low pressure also comprise spiral channels having a cross-section area that is reduced from the center to the outer periphery of the stator body. More preferably, the cross-section area of said channels varies so that the internal pumping speed is constant along the pumping stages and, particularly, satisfies the equation (1) or (2) or (3).

With reference to FIG. 5, it is to be noted that a further region can be provided upstream to the first region A'. This further region comprises, for example, a plurality of turbomolecular axial pumping stages. In this case, the outlet of the last turbomolecular stage would be connected to the inlet G' of the pumping stages of the first region A'.

Figure 6:
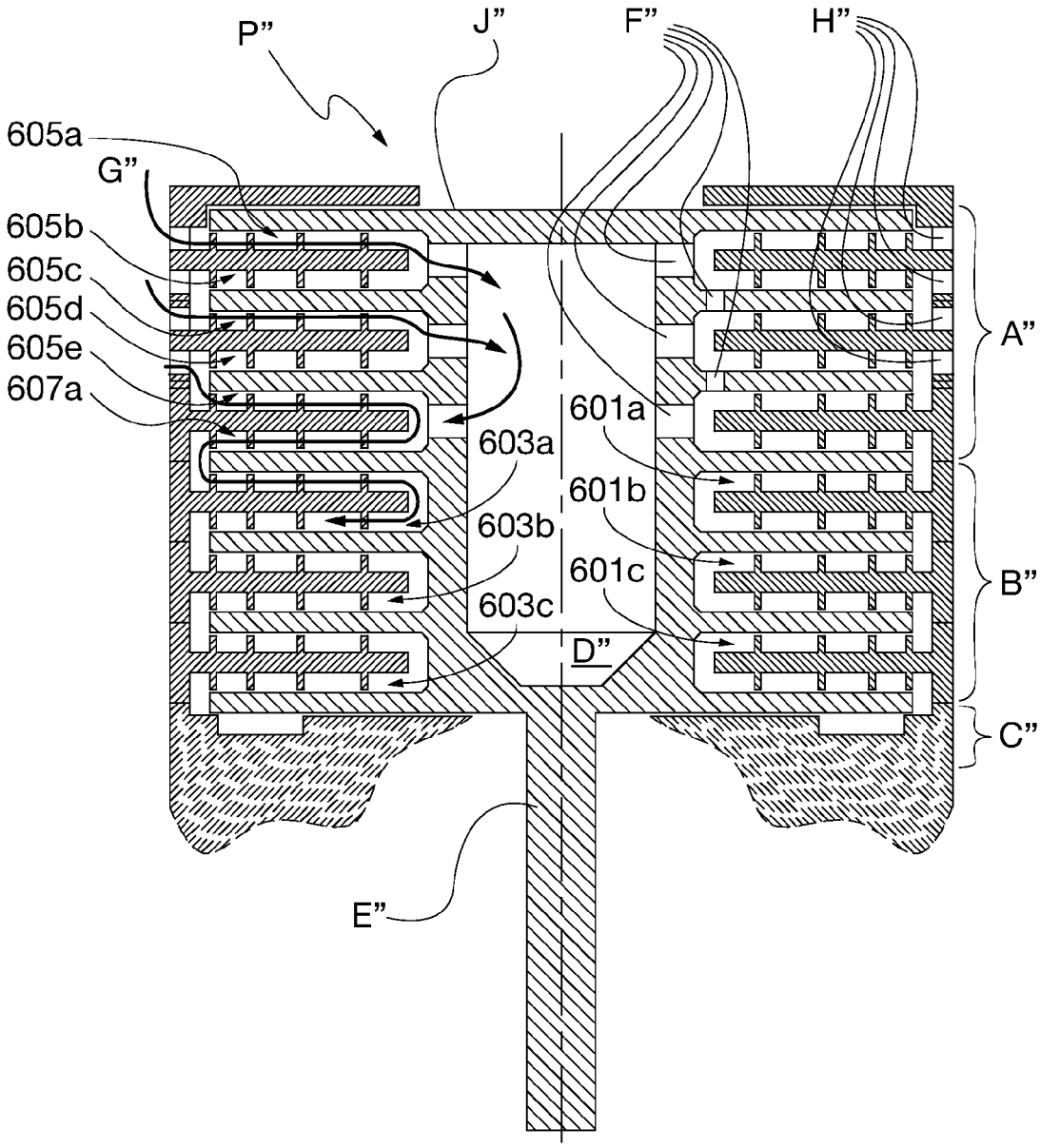
FIG. 6 is a cross-sectional view of a vacuum pump according to a third embodiment of the present invention.

Turning now to FIG. 6 showing a third embodiment of a vacuum pump P" The pump P" comprises a first region A" at low pressure, wherein a plurality of pumping stages according to the invention connected in parallel are provided (five in the example shown in FIG. 6); a second region B" at intermediate pressure, wherein spiral pumping stages connected in series are provided; and a third region C" at high pressure, wherein one or more Gaede pumping stages (which can possibly be followed or replaced by regenerative stages) are provided.

The second region B" at intermediate pressure of vacuum pump P" comprises one or more pumping stages 601*a*, 601*b*, 601*c* (three in the example shown in FIG. 6). These pumping stages 601*a*, 601*b*, 601*c* are connected in series with as many centrifugal spiral pumping stages 603*a*, 603*b*, 603*c*.

Regarding the first region A" at low pressure, the wall D" of the rotor E" comprises one or more radial through-holes F" and is closed on its upper side by a closing member J", so as to define a collector for the gas. The gas arriving from the inlet G" passes through the radial through-holes H" suitably formed in the wall of the stators of the pumping stages 605*a*, 605*b*, 605*c*, 605*d*, 605*e*, is subdivided among the several pumping stages of the first region A", flows through the pumping stages in centripetal direction and converges into the cavity D" of the rotor D", from which it enters successively the region B" at intermediate pressure of the pump P", through a centrifugal spiral pumping stage 607*a*.

With reference to FIG. 6, it is to be noted that a further region can be provided upstream to the first region A". This further region comprises, for example, a plurality of turbomolecular axial pumping stages. In this case, the outlet of the last turbomolecular stage would be connected to the inlet G" of the pumping stages of the first region A".

From FIGS. 3, 5 and 6, it will be evident to the person skilled in the art that the spiral pumping stages shown therein can be made substantially identical in structure (but for the spiral winding direction), irrespective of whether the gas to be pumped flows through them in centripetal or centrifugal direction, which remarkably simplifies the manufacturing, with a corresponding reduction of manufacturing costs.

Figure 7:
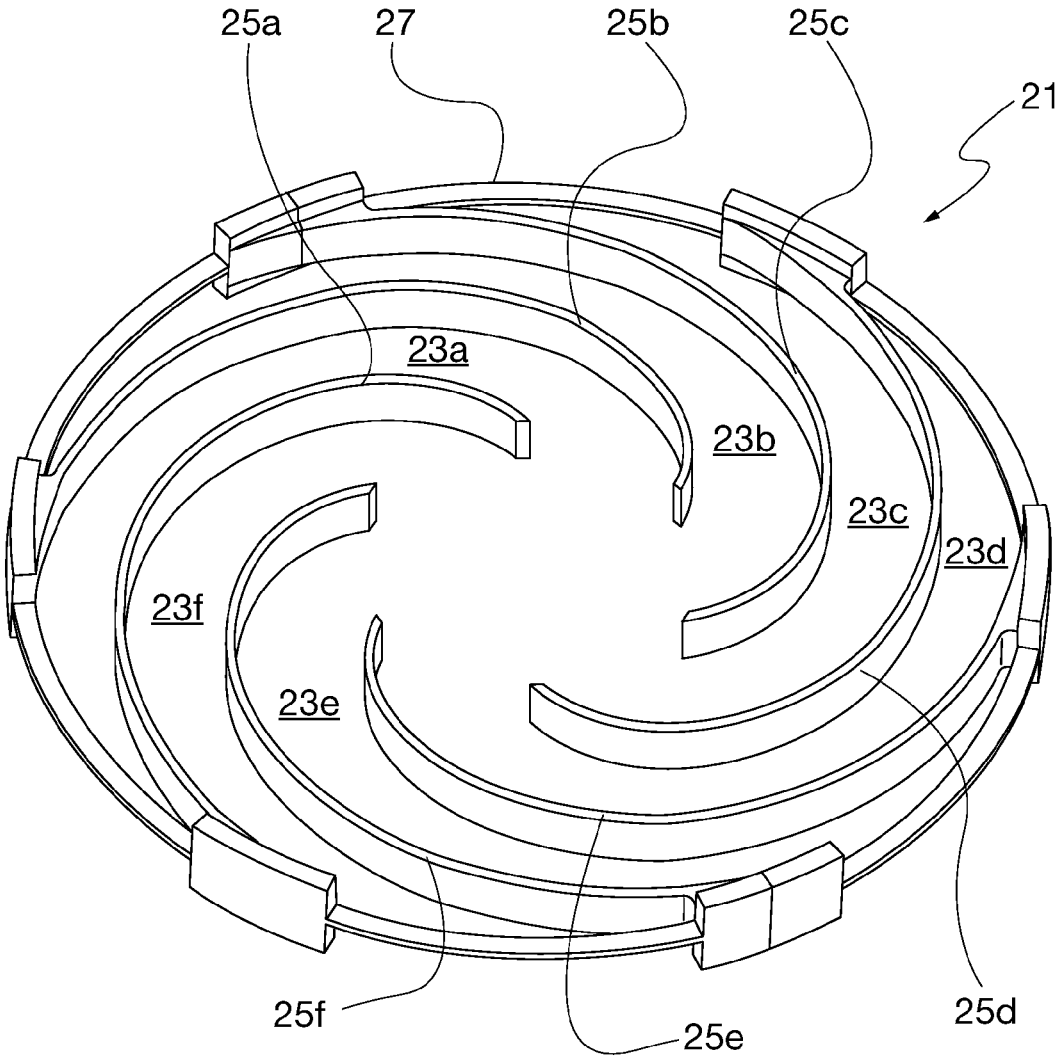
FIG. 7 is a perspective view of a stator body of a pumping stage for different embodiments of the vacuum pump of the present invention.

With reference to FIG. 7, it shows a stator 21 of a pumping stage, which is particularly suitable for applications of the kind shown in FIG. 6, where a pair of pumping stages are defined on opposite surfaces of the same stator and are connected in parallel. In this case, instead of providing separate channels on the opposite surfaces of a stator body, it is possible to provide a stator body 21 comprising an outer ring 27 that carries cantilever curved vanes 25*a*, 25*b*, 25*c*, 25*d*, 25*e*, 25*f* defining therebetween corresponding spiral channels 23*a*, 23*b*, 23*c*, 23*d*, 23*e*, 23*f*. The stator body 21 can be located between two rotor disks having smooth surfaces and cooperate therewith for forming a pair of centripetal spiral pumping stages according to the invention connected in parallel through which the pumped gas flows.

It is evident that a similar structure of the stator body could also be used for obtaining a pair of centrifugal spiral pumping stages connected in parallel, of the kind of those shown in FIG. 5. Even in this embodiment, as already disclosed with reference to the previous one, for compensation of the possible reduction of the compression ratio, it is sufficient to define an adequate number of curved vanes defining as many spiral channels in parallel on the stator body.

Preferably, the number of channels is chosen so that a theoretical observer placed at the center of the stator body always meets at least two curved vanes when moving in the radial direction from the center to the outer periphery of the stator body.

It will also be evident that the described examples and embodiments are in no way limiting and many modifications and variants are possible without departing from the scope of the invention as defined by the appended claims.

What is claimed is:

1. A molecular spiral vacuum pumping stage comprising:

a rotor disk having smooth surfaces and co-operating with a stator body, said stator body having at least one spiral channel at least on the surface facing said rotor disk;

said at least one spiral channel with a cross-section area (σ) comprising:

an inlet for a gas to be pumped at or close to an outer periphery of said stator body; and an outlet for the gas at or close to a center of said stator body, so that the gas flows through said at least one channel in a centripetal direction from the inlet to the outlet;

wherein the cross-section area (σ) of said at least one channel is reduced from the center to the periphery of said stator body in a direction opposite to the centripetal direction.

2. The molecular spiral vacuum pumping stage of claim 1, wherein said stator body is provided with a plurality of spiral channels connected in parallel and separated from each other.

3. The molecular spiral vacuum pumping stage of claim 2, wherein said cross-section area (σ) of said channels varies so that the volumetric channel speed (S) is constant to, within a maximum deviation of ±10%, whereby the volumetric channel speed (S) is determined according to the following equation:

$$S = Vn \times \sigma = 2\pi\omega H(R)R^2 \frac{\frac{dR}{Rd\phi}}{1+\left[\frac{dR}{Rd\phi}\right]^2} = \text{CONSTANT, wherein}$$

$V_n$ is half the rotor velocity normal to area σ; R is the distance from the center of the stator body; $\omega = V_T/R$ is the rotor angular velocity; $V_T$ is the local velocity of the rotor; H(R) is the height of the channel, possibly variable as a function of R; and ϕ is the winding angle of the channel spiral.

4. The molecular spiral vacuum pumping stage of 1, wherein said channels are defined and separated by corresponding spiral ribs.

5. The molecular spiral vacuum pumping stage of claim 4, wherein the number of said channels is selected so that any radius vector originated at the center of the stator body intercepts at least two of said ribs when moving in the radial direction from the center to the outer periphery of the stator body.

6. The molecular spiral vacuum pumping stage of claim 1, wherein said stator body comprises an outer ring carrying cantilever curved vanes defining therebetween corresponding spiral channels.

7. The molecular spiral vacuum pumping stage of claim 6, wherein the number of said channels is selected so any radius vector originated at the center of the stator body intercepts at least two of said ribs when moving in the radial direction from the center to the outer periphery of the stator body.

8. The molecular spiral vacuum pumping stage of 1, wherein said stator body is provided on both opposite surfaces with a plurality of spiral channels connected in parallel and separated from each other.

9. The molecular spiral vacuum pumping stage according to claim 1, wherein the cross-section area (σ) of said at least one channel is reduced from the center to the periphery of said stator body so that a volumetric channel speed (S) of the gas is substantially constant.

10. A vacuum pump having an inlet for a gas to be pumped, an outlet for the pumped gas and a plurality of pumping stages located between the inlet and the outlet, said vacuum pump comprising:

at least one centripetal pumping stage;

said at least one centripetal pumping stage comprising:

a rotor disk with smooth surfaces and cooperating with a stator body having at least one spiral channel at least on the surface facing said rotor disk;

said at least one spiral channel with a cross-section area (σ) comprising an inlet for the gas to be pumped at or close to an outer periphery of said stator body and an outlet for the gas at or close to a center of said stator body, so that the gas flows through said at least one channel in a centripetal direction from the inlet to the outlet;

wherein the cross-section area (σ) of said at least one channel is reduced from the center to the periphery of said stator body in a direction opposite to the centripetal direction.

11. The vacuum pump according to claim 10, wherein said at least one centripetal pumping stage is connected in series to a corresponding spiral pumping stage wherein the gas flows in a centrifugal direction.

12. The vacuum pump according to claim 11, wherein the stator body of said spiral pumping stage wherein the gas flows in the centrifugal direction comprises a plurality of channels having a cross-section area that is reduced from the center to the outer periphery of said stator body.

13. The vacuum pump according to claim 12, comprising a stator body provided on both surfaces with spiral channels, a first rotor having smooth surfaces and facing a first surface of said stator and cooperating therewith for forming said at least one centripetal spiral pumping stage and a second rotor having smooth surfaces and facing a second surface of said stator and co-operating therewith for forming a spiral pumping stage wherein the gas flows in the centrifugal direction.

14. The vacuum pump according to claim 10, wherein said at least one centripetal pumping stage is connected in series to a plurality of spiral pumping stages that are connected to each other in parallel and wherein the gas flows in the centrifugal direction.

15. The vacuum pump according to claim 14, wherein said spiral pumping stages wherein the gas flows in the centrifugal direction comprise each a stator body provided with a plurality of spiral channels having a cross-section area that is reduced from the center to the outer periphery of the stator body.

16. The vacuum pump according to claim 10 or 11 or 14, wherein said at least one centripetal pumping stage is connected in parallel to at least a second pumping stage of said centripetal pumping stages.

17. The vacuum pump according to claim 10, wherein said at least one centripetal pumping stage is connected in series to a pumping stage selected from the group consisting of a turbomolecular pumping stage, a Gaede pumping stage, a regenerative pumping stage, and a combination of two or more of the foregoing.

18. The vacuum pump according to claim 10, wherein the cross-section area (σ) of said at least one channel is reduced from the center to the periphery of said stator body so that a volumetric channel speed (S) of the gas is substantially constant.

* * * * *

UNITED STATES PATENT AND TRADEMARK OFFICE

CERTIFICATE OF CORRECTION

PATENT NO. : 8,152,442 B2
APPLICATION NO. : 12/343961
DATED : April 10, 2012
INVENTOR(S) : John C. Helmer et al.

It is certified that error appears in the above-identified patent and that said Letters Patent is hereby corrected as shown below:

In column 1, line 11, delete “STAGE”” and insert -- STAGE”. --, therefor.

In column 8, line 41, in Claim 4, delete “1,” and insert -- claim 1, --, therefor.

In column 8, line 59, in Claim 8, delete “1,” and insert -- claim 1, --, therefor.

Signed and Sealed this
Twenty-ninth Day of May, 2012

David J. Kappos

David J. Kappos
*Director of the United States Patent and Trademark Office*